United States Patent [19]

Beach et al.

[11] 4,069,895

[45] Jan. 24, 1978

[54] OIL LEAK SCAVENGER APPARATUS

[76] Inventors: James M. Beach, 4509 Foothill Dr., Hutchinson, Kans. 67501; Elbert R. Eastin, 629 N. Main, Newkirk, Okla. 74647

[21] Appl. No.: 685,099

[22] Filed: May 10, 1976

Related U.S. Application Data

[63] Continuation-in-part of Ser. No. 572,414, April 28, 1975, abandoned.

[51] Int. Cl.[2] ..... F16N 31/02; F16N 31/00

[52] U.S. Cl. ..... 184/106; 184/58

[58] Field of Search ..... 184/6.24, 58, 106; 123/196 A

[56] References Cited

U.S. PATENT DOCUMENTS

| | | | |
|---|---|---|---|
| 1,029,331 | 6/1912 | Winkler | 184/58 |
| 1,342,063 | 6/1920 | Perry | 184/58 |
| 1,926,741 | 9/1933 | Frye et al. | 184/6.24 |
| 2,480,486 | 8/1949 | Leazer | 184/106 |
| 2,540,134 | 2/1951 | Nelson | 123/196 A |
| 2,899,019 | 8/1959 | Colgan | 184/106 |
| 2,976,864 | 3/1961 | Ford | 184/6.24 |

*Primary Examiner*—Verlin R. Pendegrass
*Assistant Examiner*—Thomas H. Webb
*Attorney, Agent, or Firm*—F. Lindsey Scott; G. M. Burdick

[57] ABSTRACT

An oil leak scavenger apparatus for collecting oil drippings of automobile vehicles which is mounted externally to engine crankcases, transmission housings, and other oil containing units is provided. The scavenger apparatus comprises: (a) an oil collector; (b) a reservoir in fluid communication with the oil collector; (c) a vacuum source in fluid communication with the reservoir; and (d) a vacuum metering valve positioned intermediate the vacuum source and the reservoir. In one embodiment the reservoir is also in fluid communication with the oil containing unit of the automobile, and a check valve is positioned intermediate the reservoir and the oil containing unit of the automobile thus allowing the collected oil to return to its source when the engine is not running.

5 Claims, 3 Drawing Figures

OIL LEAK SCAVENGER APPARATUS

BACKGROUND OF THE INVENTION

Reference to Related Applications

This is a Continuation-in-Part of U.S. patent application Ser. No. 572,414 filed Apr. 28, 1975, entitled "Oil Leak Scavenger Means" now abandoned.

Field of the Invention

This invention relates to the automotive field, and more particularly to an oil scavenger apparatus for use with automotive vehicles.

In one aspect the invention relates to an oil leak scavenger apparatus which can readily be affixed to that portion of an automobile leaking oil.

In yet another aspect, this invention relates to a unique oil scavenger apparatus which will allow recycling of the captured oil to the oil containing unit of the automobile.

BRIEF DESCRIPTION OF THE PRIOR ART

Oil drip spots from motorized vehicles is a common, unattractive sight on driveways, garage floors, parking areas and even on highways. This oil can accumulate and become hazardous in terms of fire, or safety of anyone walking in the drip areas. Many proposals have been set forth to recover and/or prevent such oil leakage. For instance, protective covers for the automobile underbody have been proposed, as have modified oil drip pans. However, such means are often bulky and drastically reduce the clearance area between the roadway and the underneath structure of the automobile. Further, the means proposed in the prior art have complicated the repair of the automobile and are expensive.

OBJECTS OF THE INVENTION

An object of the present invention is to provide an improved oil scavenger apparatus for automotive vehicles which is simple in design and of a sturdy construction for relative trouble-free service, is economical to manufacture, and does not suffer from the before-mentioned disadvantages of the prior art.

Another object of the invention is to provide an oil scavenger apparatus which is easily accessible and detachable for emptying.

Another object of the invention is to provide an oil scavenger apparatus which will allow return of the scavenged oil to an oil containing reservoir of an automobile.

These and other objectives and advantages will become readily apparent to those skilled in the art from a reading of the following detailed description.

BRIEF DESCRIPTION OF THE DRAWINGS

Drawings accompany and are a part of this disclosure. The drawings depict preferred specific embodiments of the oil scavenger apparatus of the invention, and it is to be understood that such are not to unduly limit the scope of the invention.

In the following discussion and description of the invention, reference will be made in the drawings wherein the same reference numerals will be used to indicate the same or similar parts and/or structures.

DETAILED DESCRIPTION OF THE INVENTION

Figure 2:
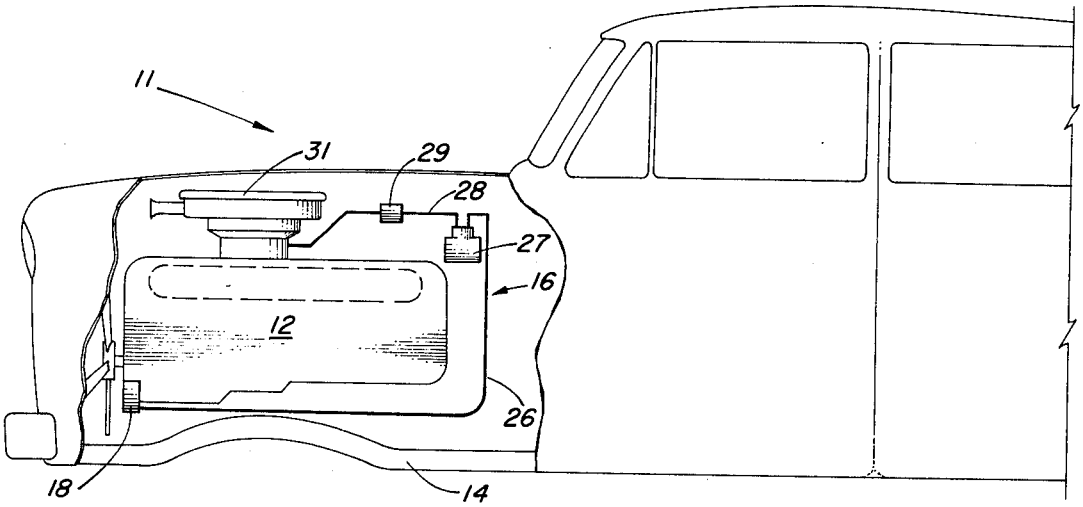
FIG. 2 is a side elevation view of the forward end of a motor vehicle showing in diagrammatic from the oil scavenger apparatus of the present invention.
Figure 1:
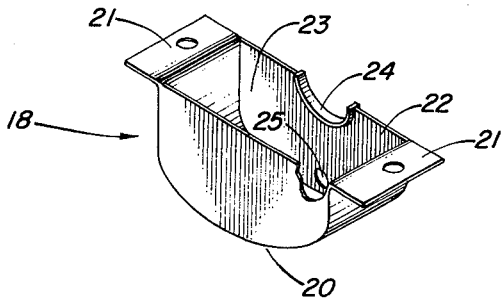
FIG. 1 is an isometric view of the oil collector of the oil scavenger apparatus of the invention.

Referring to the drawings, and particularly to FIGS. 1 and 2, an automobile vehicle 11 is shown having an engine 12, a frame 14 and an oil scavenger apparatus 16. Oil scavenger assembly 16 can be positioned upon any part of an automobile where oil leakage from an oil containing reservoir is detected. In this particular instance, oil scavenger assembly 16 is positioned so as to collect oil drippings from the forward seals of engine 12. Oil scavenger apparatus 16 comprises an oil collector 18, an oil separator reservoir 27, and a vacuum metering valve 29. Oil collector 18, which is secured beneath that portion of the automobile where the oil leak has been detected, is provided with a body member 20, and an enclosed area or chamber 23 for collecting the oil drippings, and a plurality of sealing means 21 and 22 to sealably join body member 20 of oil collector 18 to that portion of the automobile, e.g., engine, transmission, and the like, where the oil leak is occurring. Sealing means 22 is constructed so as to form fit that portion of the automobile or part thereof at a distance beyond the point or place where the oil leak is occurring. It is desirable that a gasket member 24 be employed on sealing means 22.

Sealing means 21 can be any suitable means which will allow body member 20 of oil collector 18 to be readily attached to the automobile at a position beneath the point or place where the oil leak is occurring. In this particular embodiment sealing means 21 is depicted as two flange members which can readily be bolted to the engine block so as to maintain body member 20 of oil collector 18 beneath the front seals as shown. If desired, a gasket can be utilized in combination with sealing means 21 to improve the seal.

As previously stated, oil scavenger apparatus 16 comprises oil collector 18, oil separator reservoir 27 and vacuum metering valve 29. Chamber 23 of body member 20 of oil collector 18 is in fluid communication with oil drippings reservoir 27 via a conduit 26. It is desirable that the end portion of conduit 26 communicating with oil separator reservoir 27 is near the lower portion of said reservoir. A second conduit 28, e.g. a vacuum conduit, is secured at one end portion to oil separator reservoir 27 and to a vacuum source, such as an intake manifold 31 of engine 12 at the other end portion, thus establishing fluid communication therebetween. Vacuum meter valve 29, which is positioned within conduit 28, can be any suitable vacuum metering means, such as a predesigned restriction in conduit 28, a venture type metering means, and the like. Oil separator reservoir 27 can be maintained in position by any suitable means, such as a bracket or a clamp, or, if conduits 26 and 28 are fabricated of a rigid material, the reservoir can be maintained by such conduits.

In operation, oil scavenger apparatus 16 is affixed to the automobile so that oil collector 18 is positioned beneath the element or unit leaking oil. As oil drippings are collected in oil collector 18 the vacuum created within oil separator reservoir 27 and thus oil collector 18 by the intake manifold 31 of engine 12 causes the collected oil to move through conduit 26 to reservoir 27. Vacuum metering valve 29 prevents the captured oil from being drawn into the engine through conduit 28. When it is detected that oil separator reservoir 27 is full of the collected oil drippings the reservoir is removed to empty the oil. In the alternative, a drain plug can be provided in the lower portion of oil separator reservoir 27 so that the collected oil can be drained from the reservoir by removal of the plug.

Figure 3:
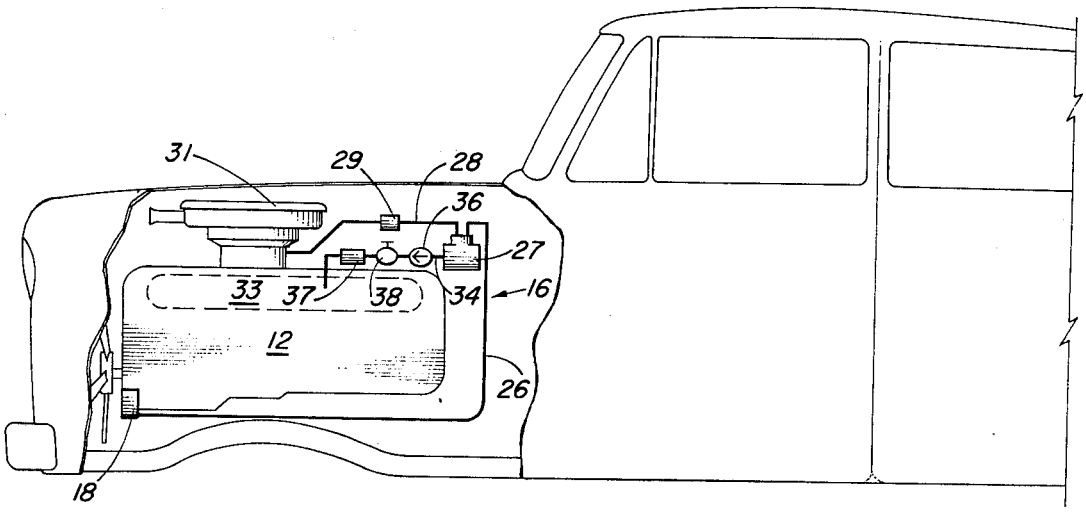
FIG. 3 is a diagrammatic side elevation view of another embodiment of the oil scavenger apparatus of the invention.

Referring now to FIG. 3, another embodiment of the oil scavenger apparatus of the present invention is shown. In this embodiment, oil leak scavenger apparatus 16 is constructed so as to not only collect oil drippings, but also to clean and recycle the collected oil to the oil containing unit or portion of the automobile. Oil scavenger apparatus 16 is provided with oil collector 18, conduit 26, oil separator reservoir 27, conduit 28, vacuum metering valve 29 and intake manifold 31 as discussed with reference to FIGS. 1 and 2 hereinbefore. The operation of collecting the oil drippings within oil collector 18 and the movement of such drippings to reservoir 27 is the same as discussed with reference to FIG. 2. However, in this embodiment the collected oil drippings are not discarded but, are cleaned and recycled to the automobile. To achieve such, a conduit 34 is secured at one end to the lower portion of oil separator reservoir 27 and at the other end to the oil containing unit of the automobile, such as the crankcase 33 of engine 12, thus establishing fluid communication between oil separator reservoir 27 and crankcase 33. A check valve 36 is positioned within conduit 34 and in fluid communication therewith. Valve 36 is a one-way valve, thus preventing the flow of oil from the crankcase 33 to oil separator reservoir 27. Valve 36 further prevents loss of vacuum through conduit 34 when the oil leak scavenger apparatus is in operation.

Since the collected oil drippings often contain foreign matter which may be deleterious to the automobile engine, it is desirable that the collected oil be filtered prior to its recycle to the crankcase. Thus, a filter 37 is positioned between check valve 36 and the crankcase of engine 12 so that all recycled oil is passed through filter 37 prior to entering the crankcase. A valve 38 is positioned within conduit 34 and in fluid communication therewith at a position intermediate filter 37 and check valve 36. Valve 38 enables one to close off the system for the changing of filter 37, or, when desired, to prevent the recycle of the collected oil to the crankcase.

In operation, vacuum is supplied from a vacuum source, such as intake manifold 31 of engine 12, to oil separator reservoir 27 and thus oil collector 18 through conduits 26 and 28. The vacuum thus created in the system allows oil separator reservoir 27 to draw collected oil from oil collector 18. Oil separator reservoir 27 not only functions as a holding vessel for the collected oil, but also as an air/oil separator. This separating action allows only air to enter intake manifold 31 of engine 12. The oil collected in reservoir 27 can, if desired, be passed through filter 37 and thus to the crankcase of engine 12. By employing the unique design of the present invention, collected oil will not return to the engine while same is in operation. This is accomplished by check valve 36 which will be in a closed position during engine operation.

While the present invention has been described as employing the intake manifold of an engine as the vacuum source, it is to be understood that other vacuum means such as electric motor could readily be employed. Further, if desired, a valve can be provided in the lower portion of oil separator reservoir 27 that one can drain the collected oil therefrom without the need of disassembling the oil scavenger apparatus.

Having thus described the preferred embodiments of the invention, it is noted that the foregoing description of preferred embodiments is illustrative rather than limiting in nature and that many variations and modifications are possible. It is anticipated that such variations and modifications may be considered obvious or desirable by those skilled in the art upon a review of the foregoing description of preferred embodiments.

Having thus described the invention, we claim:

1. An oil scavenger apparatus for collecting oil drippings from an oil containing unit of a vehicle which comprises:
   a. an oil collector means for collecting oil leaking from the oil containing unit, said collector means being configured to sealingly mate with the external surfaces of the oil containing unit in a fluid tight relationship, said oil collector means having a discharge port whereby the oil collected therein is removed therefrom;
   b. an oil separator reservoir means fluidly communicating with said oil collector means through said discharge port, said oil separator reservoir means receiving the oil from said oil collector means; and
   c. a vacuum source means fluidly communicating with said oil collector means through said oil separator reservoir means for moving the oil from said oil collector means to said oil reservoir means.

2. The oil scavenger apparatus of claim 1 which includes vacuum metering means fluidly communicating with said vacuum source means and said oil separator reservoir means to prevent discharge of the oil from said oil separator reservoir means into said vacuum source means.

3. The oil scavenger apparatus of claim 2 wherein said oil separator reservoir means is provided with a discharge port and said apparatus includes conduit means fluidly connecting said oil separator reservoir means via said discharge port with the oil containing unit of the vehicle, and a check valve means positioned in said conduit means, said check valve preventing oil from the oil containing unit from entering said oil separator reservoir means while allowing the oil from said reservoir to pass into said oil containing unit when the engine of the vehicle is not running and to prevent the loss of vacuum through said conduit means.

4. The oil scavenger apparatus of claim 3 which includes filter means to remove foreign particulate matter from the oil, said filter means being positioned in said conduit means between said oil separator reservoir means and said oil containing unit of the engine.

5. The oil scavenger apparatus of claim 4 which includes a valve means fluidly communicating with said conduit means to enable the flow of oil through said conduit means to be shut off, said valve means being positioned between said check valve means and said filter means.

* * * * *